US007075800B2

(12) United States Patent
Dias

(10) Patent No.: US 7,075,800 B2
(45) Date of Patent: Jul. 11, 2006

(54) TIMEPIECE EQUIPPED WITH A DEVICE FOR DISPLAYING TWO TIME ZONES

(75) Inventor: Carlos Dias, Carouge (CH)

(73) Assignee: Manufacture Roger Dubuis S.A., Meyrin (CH)

( * ) Notice: Subject to any disclaimer, the term of this patent is extended or adjusted under 35 U.S.C. 154(b) by 306 days.

(21) Appl. No.: 10/805,014

(22) Filed: Mar. 19, 2004

(65) Prior Publication Data

US 2004/0190382 A1 Sep. 30, 2004

(30) Foreign Application Priority Data

Mar. 28, 2003 (EP) ..... 03405211

(51) Int. Cl.
*G04B 19/22* (2006.01)
*G04B 19/24* (2006.01)

(52) U.S. Cl. ..... 363/21; 268/223; 268/220

(58) Field of Classification Search ..... 368/21–27, 368/220, 228, 232, 223
See application file for complete search history.

(56) References Cited

U.S. PATENT DOCUMENTS 125,073 A * 3/1872 Niehaus ..... 368/27
1,046,246 A * 12/1912 Albrecht ..... 368/21
2,674,085 A 4/1954 Israel
3,277,646 A * 10/1966 Howard, Sr. ..... 368/281
4,222,227 A * 9/1980 Arabian ..... 368/27
4,763,311 A 8/1988 Marvosh
5,339,293 A * 8/1994 Kamiyama et al. ..... 368/21
6,918,694 B1 * 7/2005 Speichinger et al. ..... 368/190

FOREIGN PATENT DOCUMENTS

CH 54 533 A 6/1912
DE 73 19 908 U 9/1973
DE 197 24 762 A 12/1998

* cited by examiner

*Primary Examiner*—Andrew H. Hirshfeld
*Assistant Examiner*—Leo T. Hinze
(74) *Attorney, Agent, or Firm*—Sturm & Fix LLP

(57) ABSTRACT

This timepiece is equipped with a device for displaying two different time zones and comprises three display units (1, 2, 3) driven by the minutes geartrain of the timepiece, two units (2, 3) comprising only means (5, 7, 6, 9) for indicating the hours in two respective time zones, one corresponding to the local time and the other to a determined time zone, and the third (1) of said units comprising only means (4, 8) for indicating the minutes corresponding to each of the two time zones. It comprises control means (41) for modifying the time difference between said unit for indicating the local time and the one for indicating said determined time zone.

8 Claims, 4 Drawing Sheets

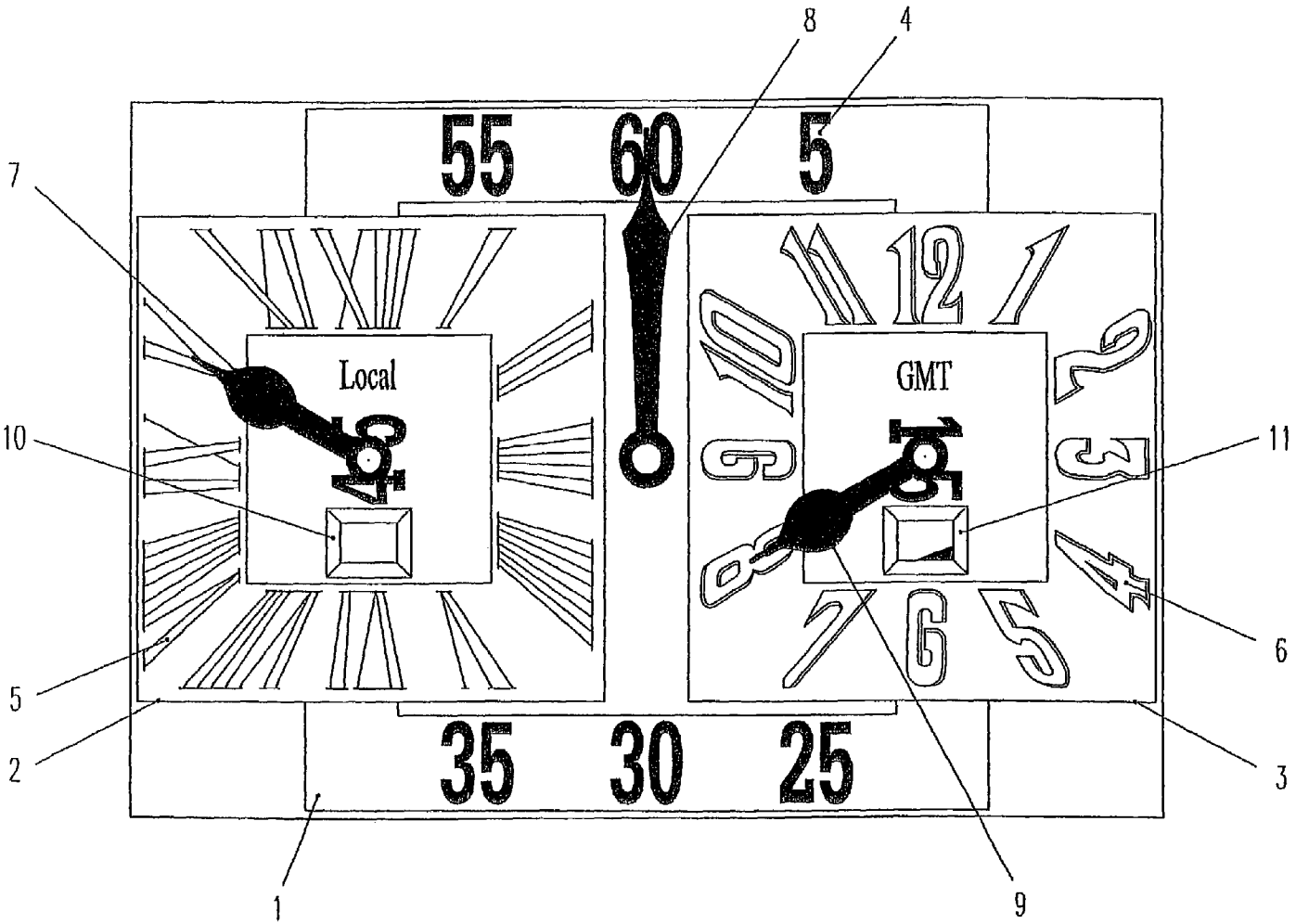
Figure n°1

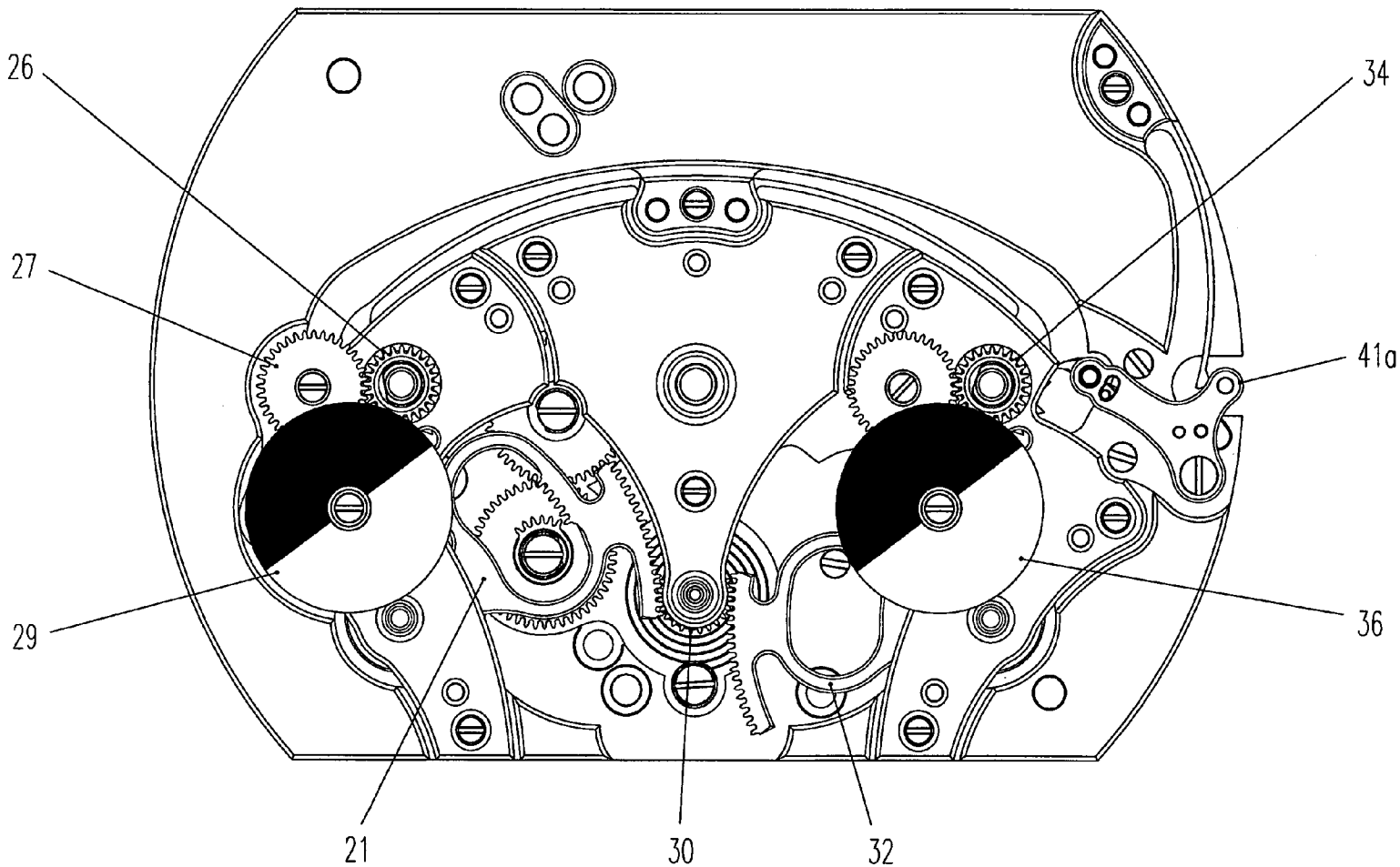
Figure n°2

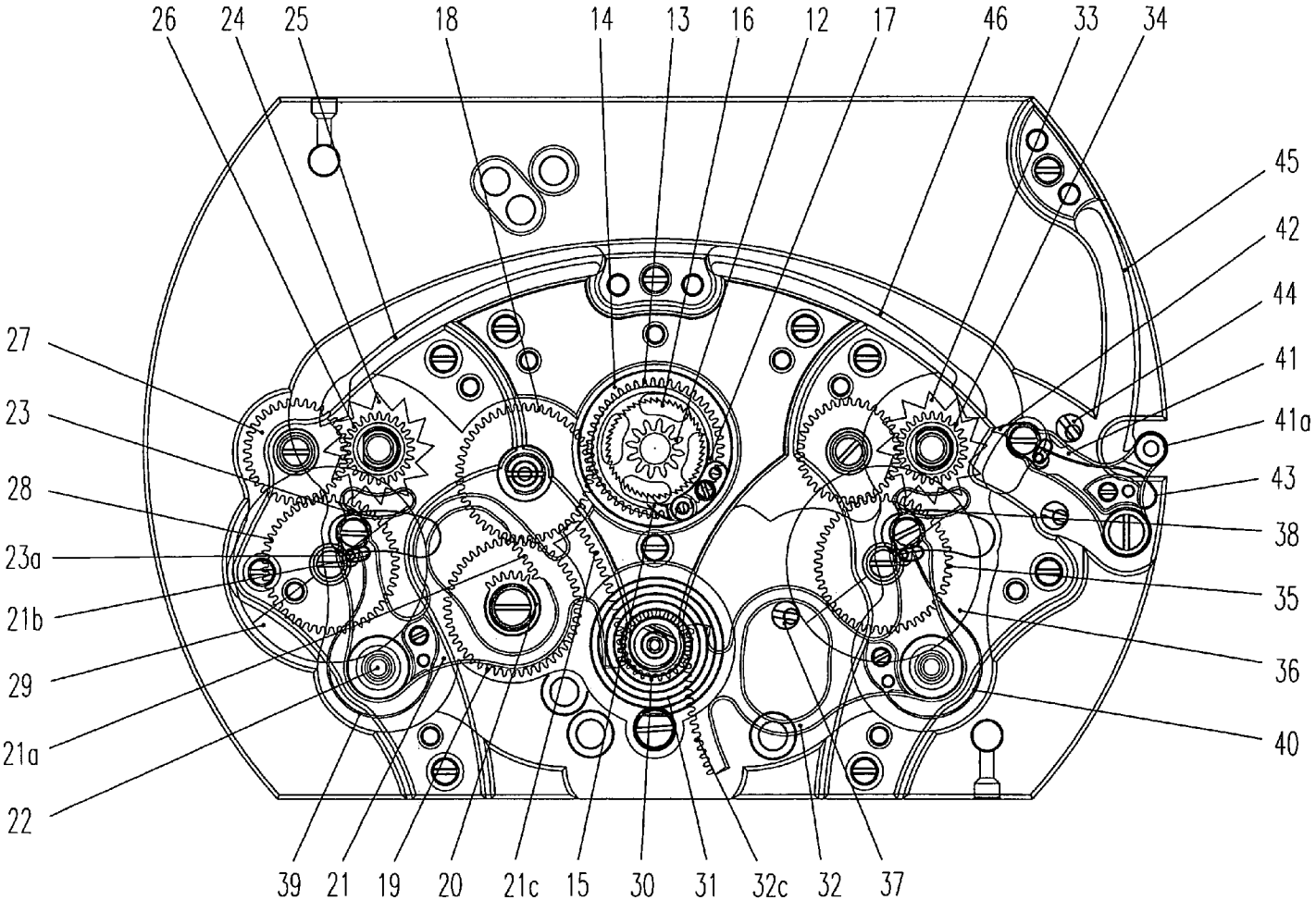
Figure n°3

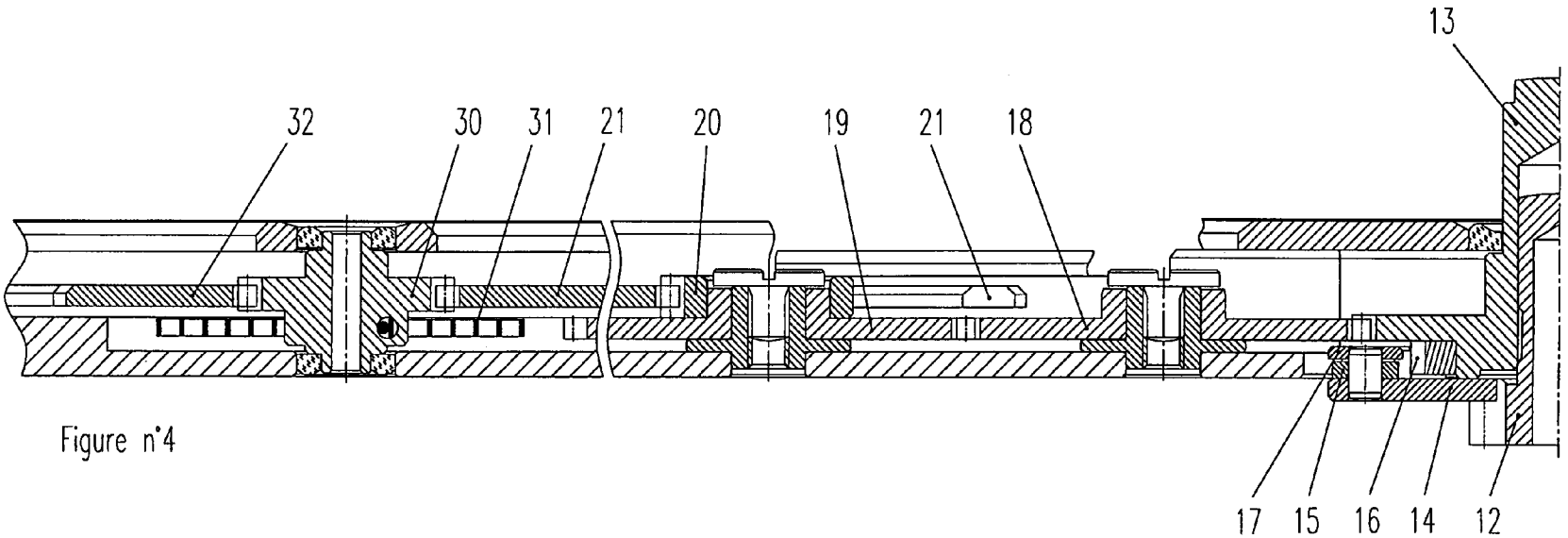
Figure n°4
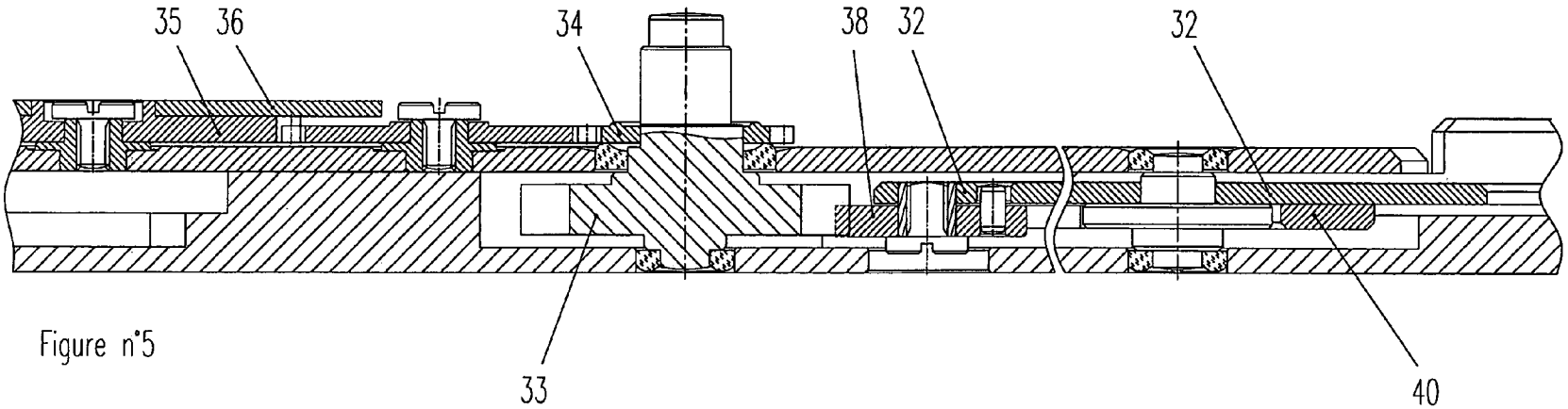
Figure n°5

TIMEPIECE EQUIPPED WITH A DEVICE FOR DISPLAYING TWO TIME ZONES

CROSS REFERENCE TO RELATED APPLICATIONS

This application claims priority of European Application No. 03405211.8 filed Mar. 28, 2003, which is included in its entirety by reference made hereto.

BACKGROUND OF THE INVENTION

1. Field of the Invention

The present invention relates to a timepiece equipped with a device for displaying two different time zones.

2. Description of Related Art

A certain number of devices for displaying several time zones exist. The disadvantage with most of the proposed devices lies in the difficulty there is in reading these devices. The usefulness of such devices is that they make it possible quickly to know the standard time in another time zone. Given that, in most cases, the time difference corresponds to whole hours, adding hours as you go east and subtracting hours as you go west, simply indicating the hour makes reading clearer, the minutes being the same in both time zones. It is also important that, when changing time zone, this change can be made simply and will always give a clear indication.

U.S. Pat. No. 2,674,085 has already proposed a timepiece comprising two hour hands one of which is associated with an indexing device having twelve positions each one corresponding to an hour and the angular position of which can be altered in whole steps according to the time difference between two time zones that are to be displayed simultaneously. Such a method of display using just one dial is not easy to read.

U.S. Pat. No. 3,277,646 proposes a collection of a plurality of watch movements, five in the example described, each of which comprises a display unit for displaying the hour, each display unit being associated with a rewinding and time-setting stem. Combining five mechanical watch movements into one single wristwatch housing is a somewhat ambitious prospect!

BRIEF SUMMARY OF THE INVENTION

The object of the present invention is to meet these requirements as best possible, using a mechanism that is simple and easy to use and to read.

To this end, the subject of the present invention is a timepiece equipped with a device for displaying two time zones as claimed in claim 1.

Advantageously, the means for indicating the hours in the two time zones are associated with step-by-step drive mechanisms. By virtue of this display mode, reading is easy, the hours indicators indicating only the whole hours in successive jumps from one hour to the next, while the minutes indicator indicates only the minutes common to the two time zones.

As a preference, the display units each comprise a dial and a hand, the axes of rotation of the three hands being aligned with the axis of rotation of the minutes hand situated between the axes of rotation of the hours hands, the respective edges of the two dials of the units for displaying the two time zones extending within the dial of the unit for displaying the minutes.

This arrangement in which the hours dials encroach upon the minutes dial brings the hours hands closer to the minutes hand and makes combining the reading of the hour with the reading of the minutes easier to do.

Other particularities and advantages of the present invention will become apparent from reading the description which follows and which relies upon the attached drawings which illustrate, schematically and by way of example, one embodiment of the timepiece that is the subject of the present invention.

BRIEF DESCRIPTION OF THE SEVERAL VIEWS OF THE DRAWINGS

FIG. 1 is a plan view of the display of the timepiece;

FIG. 2 is an actual plan view of this display mechanism;

FIG. 3 is a plan view of the display mechanism showing this mechanism and its hidden detail;

FIG. 4 is a view in section on IV—IV of FIG. 3;

FIG. 5 is a view in section on V—V of FIG. 3.

DETAILED DESCRIPTION OF THR INVENTION

The display device illustrated in FIG. 1 has three separate display units, a unit for displaying the minutes 1, and two units for displaying the hours 2, 3. Each of these display units comprises a graduation 4, 5, 6 of 60 minutes in the case for the minutes-display unit 1, and of 12 hours for each of the hours-display units 2, 3. An indicator hand 7, 8, 9 is mounted to pivot at the center of each of the graduations 4, 5, 6. The hand 8 is a minutes hand and is therefore driven at one revolution per hour and the other two hands 7, 9 are hour hands moving past 12-hour graduations and therefore each make two revolutions per day.

Each hours display unit 2, 3 preferably also comprises a window 10, 11 to allow distinction to be made between the hours of the day and the hours of the night as will be explained hereinafter.

The drive mechanism that drives this display device is illustrated in particular in FIGS. 3–5 and comprises a cannon pinion 12 friction mounted on the axle of the center wheel (not depicted) of the timepiece finishing geartrain like in all mechanical watches.

A false cannon pinion 13 is mounted, free to rotate, on the cannon pinion 12 of the minutes geartrain and is connected to it by a one-way drive device comprising an annulus 14 secured to the cannon pinion 12, on which annulus a pawl 15 is pivoted and is pressed into ratchet teeth 16 secured to the false cannon pinion 13 by a spring 17.

The false cannon pinion 13 meshes with an intermediate gear 18 which in turn meshes with a wheel 19 secured to a toothed sector 20. The path described by it as it rotates in the clockwise direction intersects the path of a toothed sector 21*a* secured to a lever 21 pivoted about a spindle 22. This lever bears a pawl 23 pressed in the clockwise direction by a return spring 39. The angular travel of this pawl 23 brought about by the return spring 39 is limited by a pin 23*a* engaged in an opening 21*b* of the lever 21. The path of this pawl 23 intersects that of a 12-toothed star wheel 24 positioned by a jumper spring 25. This star wheel 24 is secured to the hours hand 7 of the hours display unit 2. It is also secured to a pinion 26 which meshes with an intermediate gear 27 which in turn meshes with a wheel 28 secured to a day/night disk 29 (FIG. 2) that can be seen through the window 10 of the display device (FIG. 1). The toothed ratio between the pinion 26 and the wheel 28 is ½ which means that the day/night disk makes one revolution when the star wheel 24 makes two. The 12-toothed star wheel 24 makes one revolution in 12 hours, which means that the day/night disk makes one revolution in 24 hours.

The lever 21 also bears a second toothed sector 21*c* which meshes with a free pinion 30, secured to one of the ends of a spiral return spring 31. The toothed sector 32*c* of a second lever 32, arranged symmetrically with the lever 21 with respect to the free pinion 30, meshes with the latter to drive a second star wheel 33 secured to the other hour hand 9 via a pawl 38 associated with a return spring 40. Like the star wheel 24, this star wheel 33 is associated with a jumper spring 46 which allows it to advance step by step and is secured to a pinion 34 for driving a wheel 35 secured to a day/night disk 36 (FIG. 2) that can be seen through the window 11 of the display device (FIG. 1).

An eccentric stop 37 collaborates with the lever 32 to limit its travel. Given the desmodromic link between this lever 32 and the lever 21 via the free pinion 30, this stop 37 also serves to limit the travel of the lever 21, when the toothed sector 21*a* releases these levers 21 and 32 to the force of the return spring 31, each hour.

FIG. 2 illustrates the moment at which the toothed sector 20, which rotates in the clockwise direction of the watch, comes into mesh with the toothed sector 21*a* of the lever 21 to set the spiral spring 31 intended to return the levers 21, 32 to the position illustrated in FIG. 2. As they move, the levers 21, 32 drive their two respective pawls 23, 38 in the clockwise direction. During this movement, these pawls 13, 38 pivot in the counterclockwise direction when they encounter the teeth of the respective star wheels 24, 33. They are then returned to the rest position illustrated by their respective return springs 39, 40 so that they drive the respective star wheels 24, 33 by one step when the levers 21, 32 are returned by the spiral spring 31 to the position illustrated in FIG. 2.

The star wheel 33 can also be driven manually to adjust the position of the hours hand 9 with respect to the hours hand 7 according to the time zone that is to be displayed. For this, a lever 41, equipped with a pawl 42 similar to the pawls 23, 38 of the levers 21, 32 and returned by a spring 43, is pressed against a stop 44 by a return spring 45. This lever 41 has an arm 41*a* intended to mesh with an actuating push rod (not depicted) passing through the watchcase to allow the user to display the desired time zone.

The invention claimed is:

1. A timepiece equipped with an analog device for displaying two different time zones, and which comprises three distinct display units each comprising an indicator member and a time division, drive members for establishing a link between said indicator members and a minutes geartrain of the timepiece, two of said display units comprising only indicator members and divisions for indicating the hours of two respective time zones, one corresponding to the local time and the other to a determined time zone and the third of said units comprising only an indicator member and a division for indicating the minutes corresponding to each of the two time zones and which timepiece also comprises control means for modifying the time difference between said unit for indicating the local time and the one for indicating said determined time zone.

2. The timepiece as claimed in claim 1, in which each of said display units comprises a dial associated with a hand, the axes of rotation of the three hands being aligned with the axis of rotation of the minutes hand situated between the axes of rotation of the hours hands, the respective edges of the two dials of the units for displaying the two time zones extending within the dial of the unit for displaying the minutes.

3. The timepiece as claimed in claim 1, in which timepiece said drive members for establishing a link between said indicator members and a minutes geartrain comprise a step-by-step drive mechanism for driving said indicator members, said control means for modifying the time difference being designed to act directly on a step-by-step drive runner bearing the indicator member for indicating said determined time zone.

4. The timepiece as claimed in claim 3, in which a desmodromic link connects said step-by-step drive mechanisms of said means for indicating the hours together.

5. The timepiece as claimed in claim 4, in which timepiece each of said step-by-step drive mechanisms comprises a lever (21, 32) for the step-by-step drive of said indicator members for indicating the hours, these levers being connected to one another by a desmodromic connecting member subjected to elastic return means and in which a drive member actuated by the minutes geartrain is designed to periodically move said levers against the force of said elastic return means and to release them to the force of these elastic return means in order to drive said hour indicating means by one step.

6. The timepiece as claimed in claim 5, in which timepiece said drive member actuated by said minutes geartrain is a toothed sector secured to a runner connected to the minutes geartrain to make one revolution in one hour and which is intended in each revolution to engage with a toothed member kinematically secured to said drive levers.

7. The timepiece as claimed in claim 1, in which timepiece a one-way connection connects said minutes geartrain with the drive mechanisms that drive the two units displaying the two time zones.

8. The timepiece as claimed in claim 1, in which timepiece said means for indicating the hours in two time zones indicate the hours in cycles of 12 hours and are each connected to an indicator of the hours in the day and in the night.

* * * * *